US008308253B2

(12) United States Patent
Han et al.

(10) Patent No.: US 8,308,253 B2
(45) Date of Patent: Nov. 13, 2012

(54) INK JET IMAGE FORMING APPARATUS AND METHOD OF CONTROLLING THE SAME

(75) Inventors: Eun Bong Han, Suwon-si (KR); Nam Kyua Kim, Seongnam-si (KR); Kyu Suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1157 days.

(21) Appl. No.: 12/117,142

(22) Filed: May 8, 2008

(65) Prior Publication Data

US 2009/0051957 A1 Feb. 26, 2009

(30) Foreign Application Priority Data

Aug. 24, 2007 (KR) ..... 10-2007-0085584

(51) Int. Cl.
*B41J 29/38* (2006.01)
*B41J 29/393* (2006.01)
*B41J 2/015* (2006.01)

(52) U.S. Cl. ..... 347/9; 347/19; 347/20

(58) Field of Classification Search ..... 347/5, 9, 347/19–20

See application file for complete search history.

(56) References Cited

FOREIGN PATENT DOCUMENTS

| | | | |
|---|---|---|---|
| JP | 63-257659 | | 10/1988 |
| JP | 63257659 | A * | 10/1988 |
| JP | 5138917 | | 6/1993 |
| JP | 08080631 | A * | 3/1996 |

OTHER PUBLICATIONS

Korean Office Action Issued on Feb. 28, 2012 in KR Patent Application No. 10-2007-0085584.

* cited by examiner

*Primary Examiner* — Jason Uhlenhake
(74) *Attorney, Agent, or Firm* — Stanzione & Kim, LLP

(57) ABSTRACT

An ink jet image forming apparatus includes a reset correction unit to restrict a heater driving time so as to prevent a heater from being damaged due to overheating when an error occurs in a system clock. The reset correction unit may determine that an error occurs in the system clock if a discharging voltage of at least one charging circuit, which performs a charging operation using the system clock, is decreased to a reference voltage. In this case, the reset correction unit can generate a reset signal having an initial state such that the heater is no longer driven.

14 Claims, 8 Drawing Sheets

INK JET IMAGE FORMING APPARATUS AND METHOD OF CONTROLLING THE SAME

CROSS-REFERENCE TO RELATED APPLICATIONS

This application claims the benefit of Korean Patent Application No. 2007-85584, filed on Aug. 24, 2007 in the Korean Intellectual Property Office, the disclosure of which is incorporated herein in its entirety by reference.

BACKGROUND OF THE INVENTION

1. Field of the Invention

The present general inventive concept relates to an ink jet image forming apparatus capable of preventing a heater from overheating and damaging a print head when an error occurs in a system clock, and a method of controlling the same.

2. Description of the Related Art

An ink jet print head used in an ink jet image forming apparatus is able to eject droplets of ink onto a printing medium at a desired position so as to form an image.

The ink jet print head is generally divided into two types: a thermal driving type and a piezoelectric driving type, depending on the mechanism used to eject the ink droplets. The thermal driving type ink jet print head heats the ink contained in an ink chamber using heaters to generate bubbles in the ink, and then ejects the ink droplets in correspondence with a plurality of nozzles by the expansion force of the bubbles.

In such an ink jet image forming apparatus, a printer main body sends a signal for driving the heaters to the print head through serial communication, and a logic circuit formed in a head chip mounted in the print head controls the operation of the heaters to eject the ink droplets.

As illustrated in FIG. 1, a head chip HC1 of a print head includes an input data processor 10 which determines whether data received from a printer main body is printing data or common data so as to set up the status of the head chip, and processes the data. A heater controller 100 including a printing data processor 100*a* is provided to receive and process the printing data from the input data processor 10, and a heater driver 100*b* is provided to drive heaters so as to eject ink through the nozzles. A strobe signal generator 20 is used to count a serial clock received from the printer main body and to generate a strobe signal for driving the heaters, and an ink channel (not illustrated) is provided to contain the ink which is ejected through the plurality of nozzles by the pressure of the bubbles generated by the driving of the heaters.

The input data processor 10 divides the serial data into address ADDR and primitive data P_data, sends the address ADDR and primitive data P_data to the heater controller 100 if the serial data received from the printer main body through the serial communication is printing data, and analyzes the data and sets up a register of the strobe signal generator 20 and the head chip if the serial data is common data.

The strobe signal generator 20 counts the serial clock in synchronization with a load signal LOAD, generates a strobe pulse STRB for driving the heaters, and sends the strobe pulse to the heater controller 100.

The heater controller 100 includes the printing data processor 100*a* and the heater driver 100*b* to analyze the serial data received from the printer main body and to selectively drive the plurality of heaters.

Referring to FIG. 2, in order to simplify the system, the primitive data P_data and the address ADDR are transmitted through serial signal lines.

A reset signal RESET is applied to shift registers 103 and 106 and latch circuits 104 and 105. Thereafter, the shift registers 103 and 106 receive the primitive data P_data and the address ADDR in synchronization with the system clock SCLK, in order to select a nozzle corresponding to a certain heater.

The latch circuits 104 and 105 respectively latch the primitive data P_data and the address ADDR received from the shift registers 103 and 106 when receiving a load signal LOAD.

When the strobe pulse STRB is inputted to eject the ink through the nozzles, the latched signals are sent to a transistor (or a field effect transistor (FET)) of the corresponding nozzle through an AND gate 101 so as to turn on the transistor. A driving voltage Vph is applied to a thermal element of the heater corresponding to each nozzle, causing a driving current to flow in the heater, thereby ejecting the ink contained in the ink channel.

As illustrated in FIG. 3, when the load signal LOAD is inputted, the data is latched to the AND gate 101. The nozzles which eject the ink by a first strobe pulse STRB_1 become the nozzles corresponding to first data Data_1 and the nozzles which eject the ink by a second strobe pulse STRB_2 become the nozzles corresponding to second data Data_2. A time period when the current flows in the heater, that is, a heater driving time, is determined according to the pulse widths of the first strobe pulse STRB_1 and the second strobe pulse STRB_2.

As described above, the print head can receive the system clock SCLK, the serial data, the load signal LOAD and the reset signal RESET from the printer main body through the serial communication, in order to drive the heater.

Since the signal transmitted by the printer main body is transmitted in synchronization with the system clock SCLK, a head controller (not illustrated) of the printer main body to generate the system clock must include a complicated logic circuit so as to synchronize the timing of the signal.

If the printer main body is affected by electromagnetic interference due to reduction of electromagnetic susceptibility (EMS) during a printing operation, the printer main body is exposed to electrostatic discharge (ESD) such that latch-up of the system is caused, and abnormal operations are performed in the head controller of the printer main body, or connection failure occurs in a connector to connect a signal line between the printer main body and the print head. Thus, errors may occur in the system clock SCLK.

If the above-described abnormal phenomenon occurs in a process of counting the system clock SCLK received from the printer main body and generating the strobe pulse STRB for controlling the time period when the current flows in the heater, that is, if the system clock is stopped while the clock is counting, the system clock is continuously maintained at a low level as denoted by F1 of FIG. 4, and thus the strobe pulse STRB is continuously maintained at an enabled state. Thus, the heater is continuously driven for a long period of time and is damaged due to overheating of the heater. If the heater is damaged, the ink is not ejected through the nozzle corresponding thereto and thus print quality deteriorates.

To address this problem, a strobe pulse may be generated using a separate clock which is driven independent of the head controller of the printer main body. However, since the EMS should be considered, such methods are limited since the driving frequency of the separate clock should be lower than that of the system clock SCLK received from the printer main body. In addition, since the separate clock is not synchronized with the serial data and the system clock SCLK received from the printer main body, it is difficult to adjust the pulse width of the strobe pulse with high precision.

As described above, if the system clock is normal, the driving of the heater is performed in order to eject the ink. However, if an error occurs in the system clock due to ESD, the driving of the heater needs to be restricted, else the heater may be damaged.

SUMMARY OF THE INVENTION

The present general inventive concept can prevent a heater from being damaged by restricting the driving of the heater when an error occurs in a system clock of an ink jet image forming apparatus.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an ink jet image forming apparatus including a printer main body, a print head to communicate with the printer main body, and a reset correction unit to correct a reset signal supplied from the printer main body to the print head to an initial state when an error occurs in a system clock, and to supply the corrected reset signal to the print head to disable the print head.

The reset correction unit may correct the reset signal when the system clock is maintained at a certain level without change.

The reset correction unit may include at least one charging circuit to alternately perform charging and discharging operations according to alternative states of the system clock, and a logic circuit to generate a reset signal having an initial state when a discharging voltage of the at least one charging circuit is equal to or less than a reference voltage.

When the system clock is maintained in one state for a time period equal to or greater than a predetermined time period, the logic circuit may switch the reset signal from an engaged state to an initial state when the discharging voltage of the at least one charging circuit is equal to or less than the reference voltage.

The at least one charging circuit may include at least one switch and at least one capacitor, both of which may be operated by the system clock.

When the system clock is alternately switched between a high level and a low level, the switch may be turned on when the system clock has the low level such that the charging circuit is switched to a discharging mode, and may be turned off when the system clock has the high level such that the charging circuit is switched to a charging mode.

The ink jet image forming apparatus may further include at least one inverter to invert the level of the system clock, and the switch may be connected to an output side of the inverter.

The switch may be a PMOSFET.

The error may occur when the system clock is stopped for a time period equal to or greater than a predetermined time period due to electrostatic discharge (ESD).

If the reset correction unit includes a plurality of charging circuits, any one charging circuit may generate the reset signal having the initial state when the system clock is maintained at a first level and another charging circuit may generate the reset signal having the initial state when the system clock is maintained at a second level different from the first level.

The foregoing and/or other aspects and utilities of the present general inventive concept may be achieved by providing a method of controlling an ink jet image forming apparatus in which a printer main body and a print head exchange a signal so as to perform a printing operation, the method including receiving a system clock from the printer main body and generating a reset signal, detecting whether an error occurs in the system clock, and correcting the reset signal and generating a reset signal having an initial state when the error occurs in the system clock.

The detecting of the error of the system clock may include detecting the error on the basis of a time period when the level of the system clock is constantly maintained.

The detecting of the error of the system clock may include detecting that the error occurs, if a discharging voltage of at least one charging circuit reaches a reference voltage when the level of the system clock is constantly maintained and the at least one charging circuit is in a discharging mode.

The detecting of the error of the system clock may include detecting the error when the high level of the system clock is maintained during a predetermined time period or when the low level of the system clock is maintained during the predetermined time period.

If a system clock is normal, the driving of a heater may be performed in order to eject ink. In contrast, if an error occurs in a system clock due to ESD, a reset signal may be generated so as to initialize the system such that the driving of the heater is stopped. Accordingly, it is possible to prevent the heater from being damaged and improve reliability of a product.

The foregoing and/or other aspects and utilities of the present general inventive concept may be achieved by providing an ink jet image forming apparatus, including a print head, a printer main body to generate a reset signal and a system clock to drive the print head, and a reset correction unit to correct the reset signal and disable the print head when the system clock is maintained substantially constant beyond a predetermined time period.

The system clock may switch between a high level and a low level, and the reset correction unit may correct the reset signal when the system clock is maintained at the high level or the low level beyond the predetermined time period.

The print head may include a heater unit, and a strobe signal generator to generate a strobe pulse to drive the heater unit, wherein the corrected reset signal print is communicated to the strobe signal generator to stop the heater unit.

The foregoing and/or other aspects and utilities of the present general inventive concept may be achieved by providing a method of controlling a print head of an ink jet image forming apparatus, the method including generating a reset signal and a system clock to drive the print head, and correcting the reset signal to disable the print head when the system clock is maintained substantially constant beyond a predetermined time period.

The foregoing and/or other aspects and utilities of the present general inventive concept may be achieved by providing a computer readable recording medium having embodied thereon a computer program to execute a method of controlling a print head of an ink jet image forming apparatus, the method including counting a system clock to detect if the system clock has been stopped, and initializing a reset signal to disable the print head when the system clock has been stopped beyond a predetermined time period.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
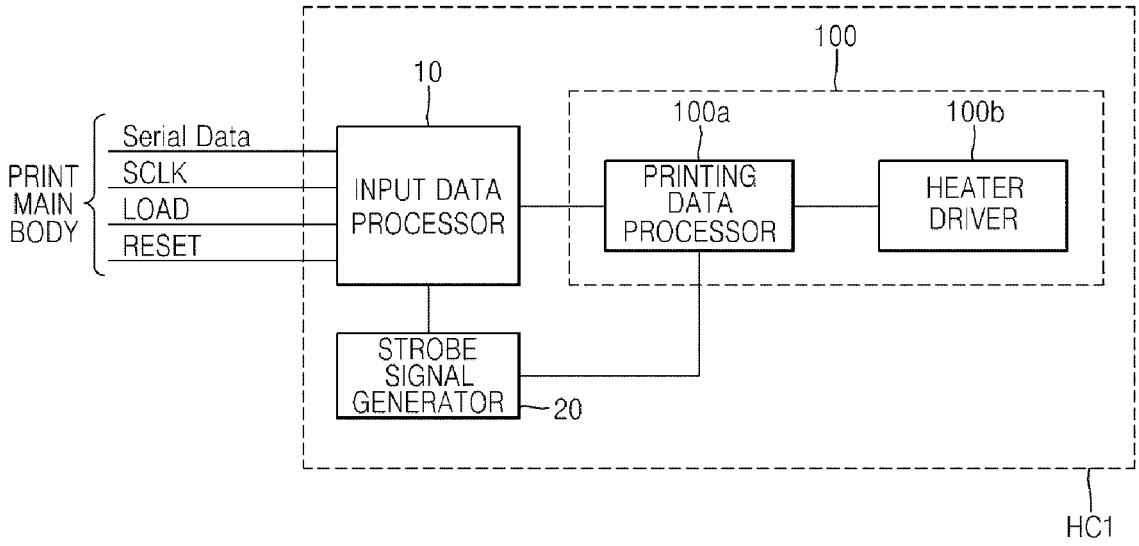
FIG. 1 (RELATED ART)
FIG. 1 is a block diagram illustrating a conventional head chip configuration in communication with a printer main body.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, an ink jet image forming apparatus and a method of controlling the same according to an embodiment of the present general inventive concept will be described.

Figure 2:
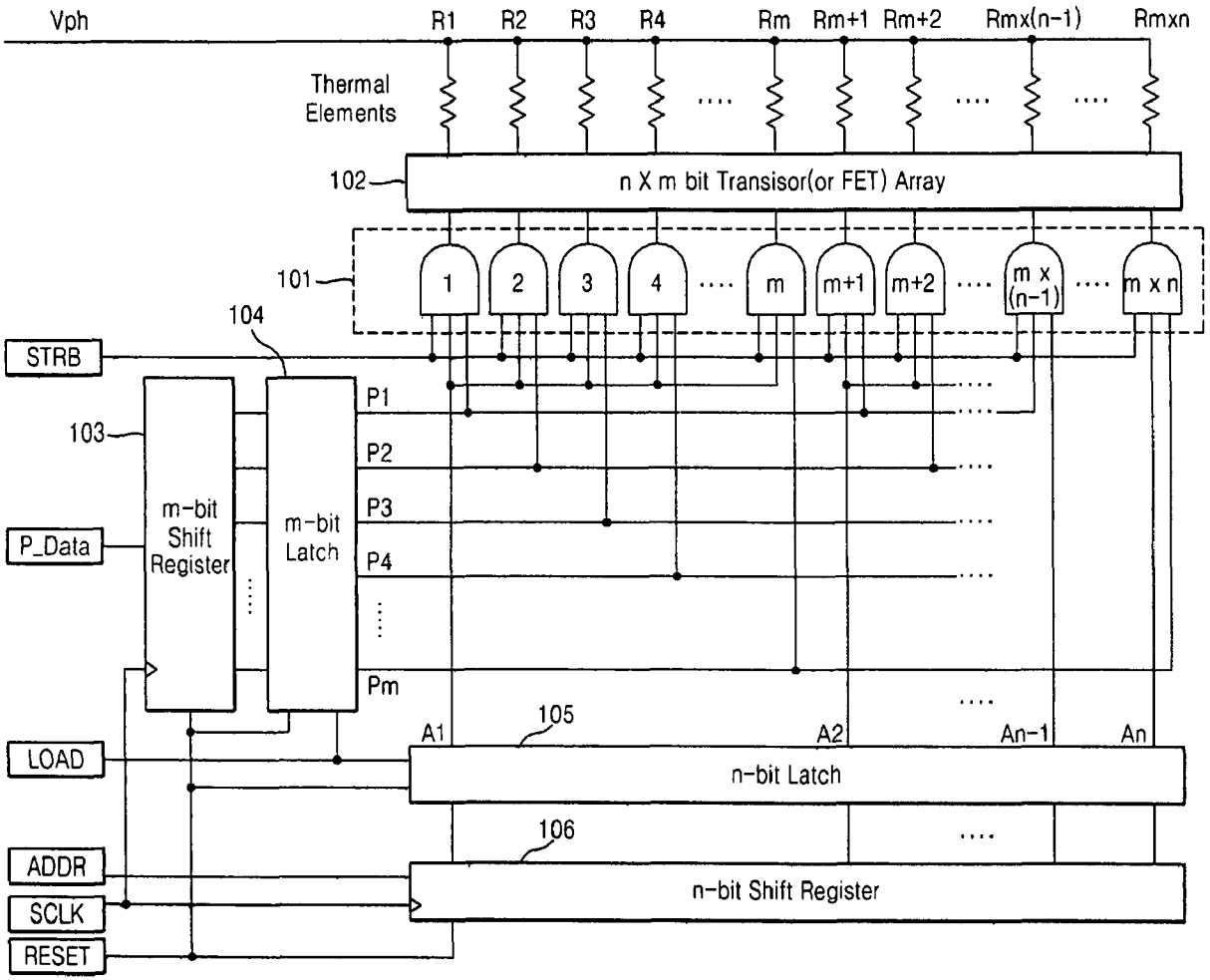
FIG. 2 (RELATED ART)
FIG. 2 is a block diagram illustrating in detail the configuration of a conventional heater controller illustrated in FIG. 1.
Figure 3:
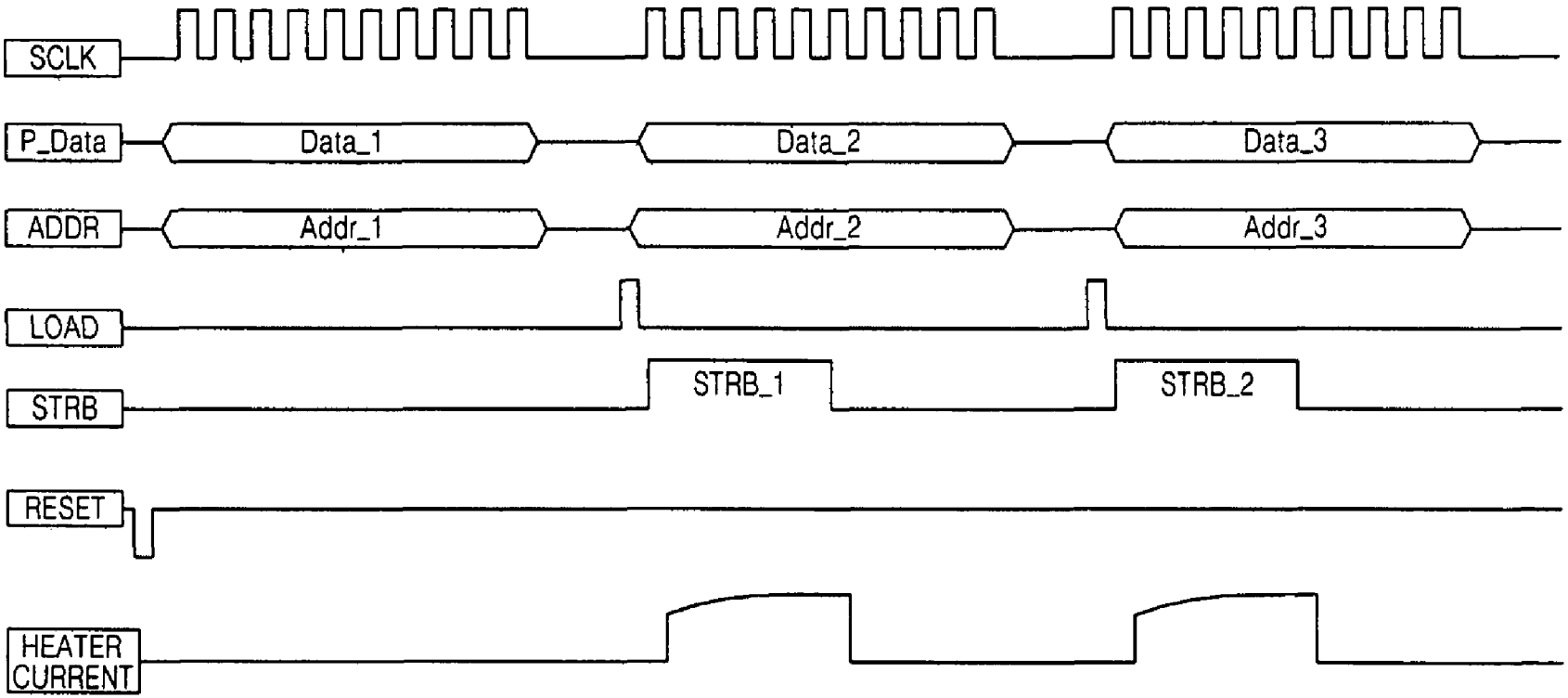
FIG. 3 (RELATED ART)
FIG. 3 is a timing chart illustrating signal timings of components illustrated in FIG. 1.
Figure 4:
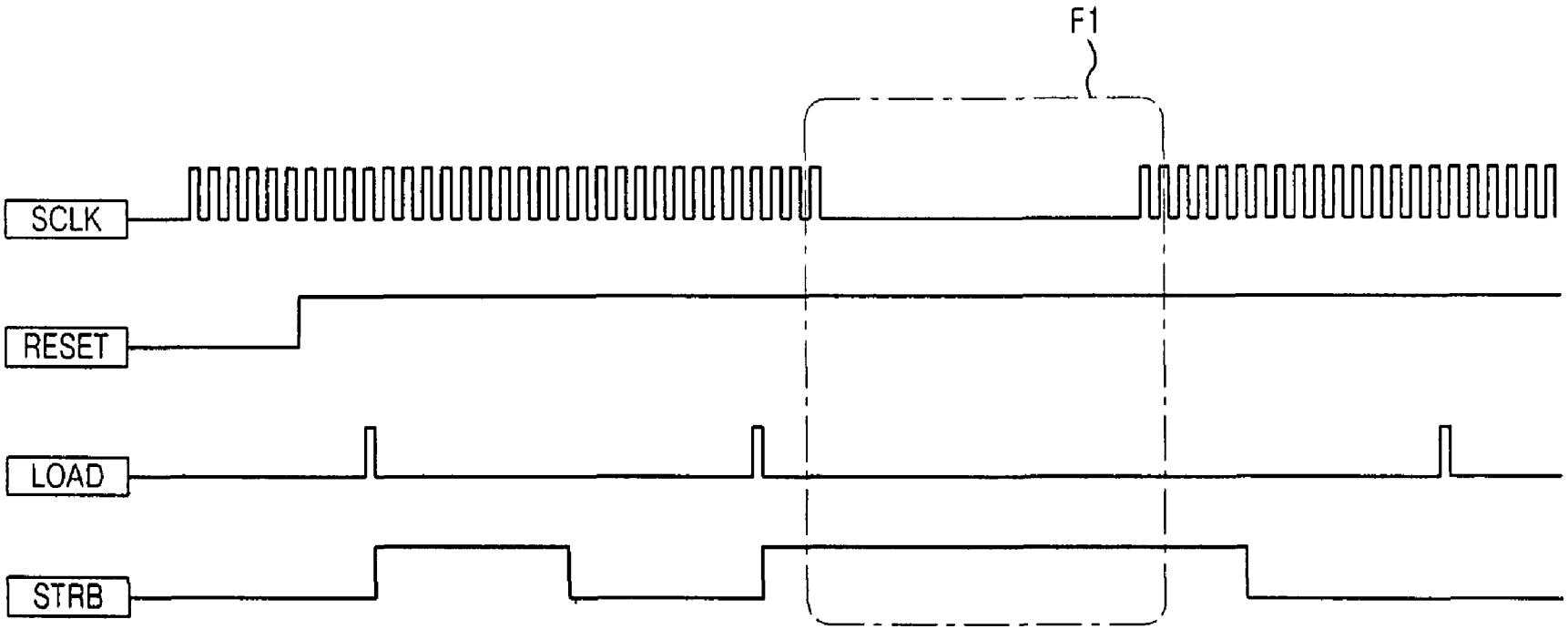
FIG. 4 (RELATED ART)
FIG. 4 is a timing chart illustrating signal timings of a conventional heater operation when an error occurs in a system clock supplied to the heater controller of FIG. 1.
Figure 5:
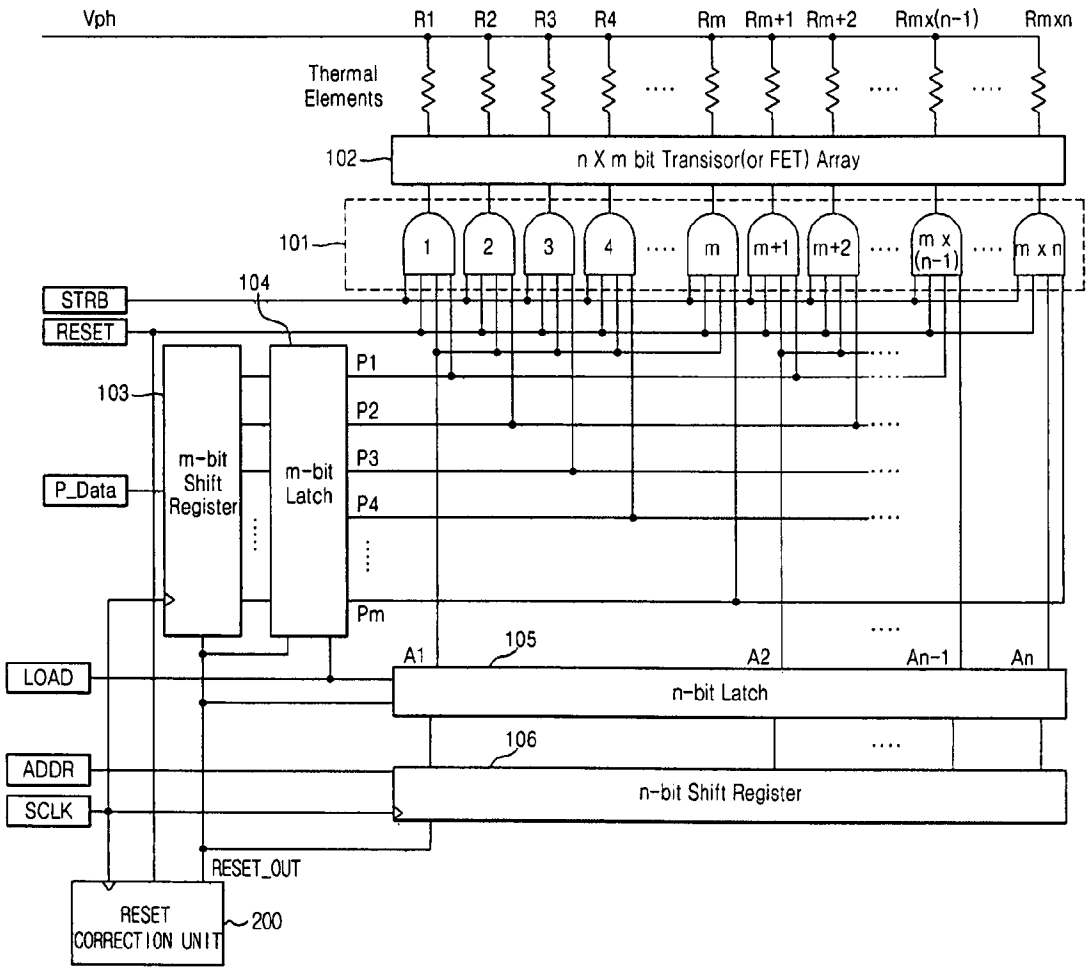
FIG. 5 is a block diagram illustrating in detail the configuration of a heater controller using a reset correction unit according to an embodiment of the present general inventive concept.

FIG. 5 is a block diagram illustrating in detail the configuration of a heater controller 100 using a reset correction unit 200 according to an embodiment of the present general inventive concept. Among the components of FIG. 5, components having the same functions as the components illustrated in FIG. 2 are represented by the same reference numerals and will be described in brief, and newly added components are represented by new reference numerals and will be described in detail.

Referring to FIGS. 1 and 5, a heater controller 100 can receive primitive data P_data, an address ADDR, a load signal LOAD, a system clock SCLK, a reset signal RESET from a printer main body and an input data processor 10, and can receive a strobe pulse from a strobe signal generator 20. This configuration is similar to the conventional configuration and thus the description thereof will be omitted. The heater controller 100 can be installed in a head chip or out of a head chip of the inkjet head.

In the present embodiment, the heater controller 100 includes a reset correction unit 200 to control the reset signal. The reset correction unit 200 can receive the reset signal RESET from the printer main body to enable or disable the reset signal depending on whether an error occurs in the system clock SCLK, and then can generate a corrected reset signal RESET_OUT as illustrated in FIG. 5.

An error in the system clock may occur, for example, when the system clock is stopped, or latched, due to electrostatic discharge (ESD) when the printer main body is affected by electromagnetic interference due to reduction of electromagnetic susceptibility (EMS) during a printing operation. However, it is understood that other types of system clock errors may also be detected without departing from the principles and spirit of the present general inventive concept.

In accordance with an embodiment of the present general inventive concept, if an error does not occur in the system clock SCLK, the reset correction unit 200 may output the same reset signal RESET_OUT as the original reset signal RESET. However, if an error occurs in the system clock SLCK, for example, if a time period when the system clock SCLK is maintained at a low level during a printing operation is equal to or greater than a reference time T, the reset correction unit 200 may disable the original reset signal (of the enable state), and generate a corrected reset signal RESET_OUT (of the disable state).

In this case, the components 103, 104, 105 and 106 which receive the corrected (i.e. disabled) reset signal RESET_OUT are reset or initialized. Here, the strobe signal generator 20, which can receive the corrected reset signal RESET_OUT, does not enable the strobe pulse which drives the heater. Accordingly, the driving of the heater is stopped such that energy is not supplied to the heater. Thus, the heater can be prevented from being overheated and the heater can be prevented from being damaged.

Figure 6:
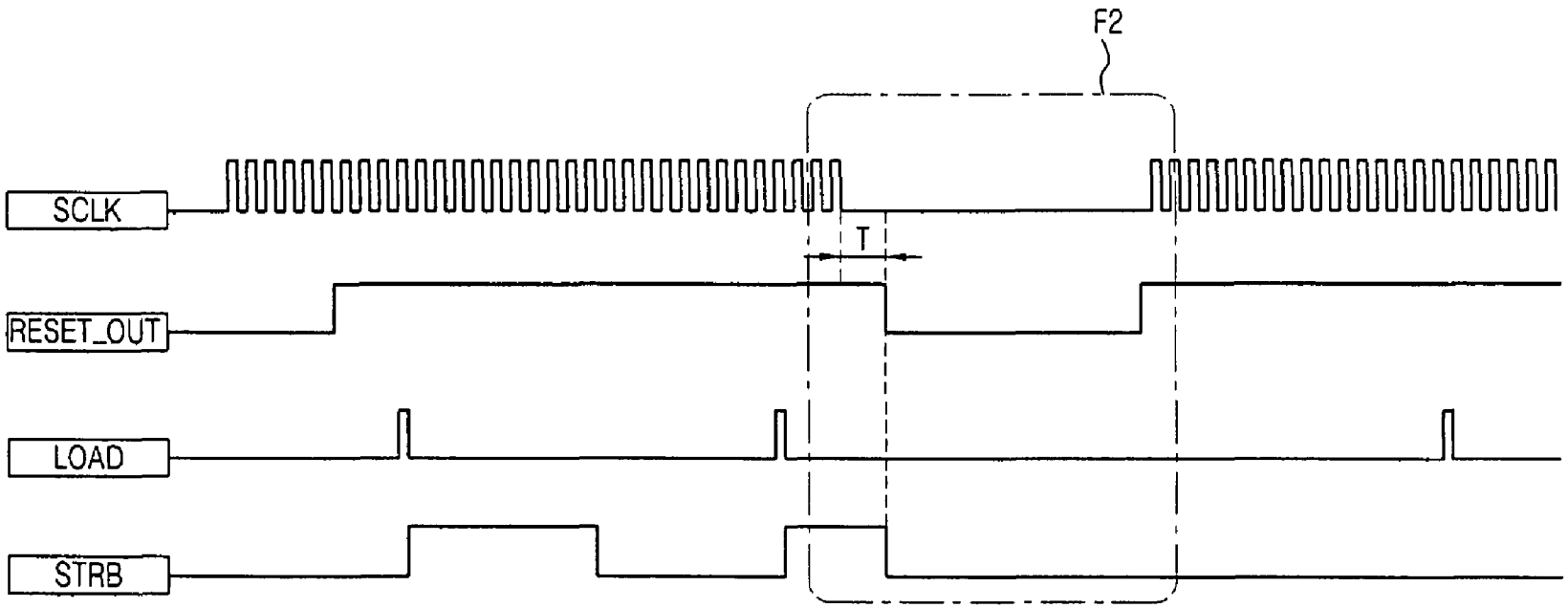
FIG. 6 is a timing chart illustrating signal timings when the reset correction unit generates a corrected reset signal when an error occurs in the system clock to control the heater operation, according to an embodiment of the present general inventive concept.

FIG. 6 is a timing chart illustrating signal timings when the reset correction unit generates a corrected reset signal when an error occurs in the system clock to control the heater operation, according to an embodiment of the present general inventive concept. Here, if the system clock is stopped while the clock is counting, the system clock is continuously maintained at a low level as denoted by F2. However, after a time period T, the reset correction unit 200 disables reset signal RESET_OUT, thus disabling the strobe pulse STRB. Accordingly, the heater can be stopped and prevented from being damaged.

Figure 7:
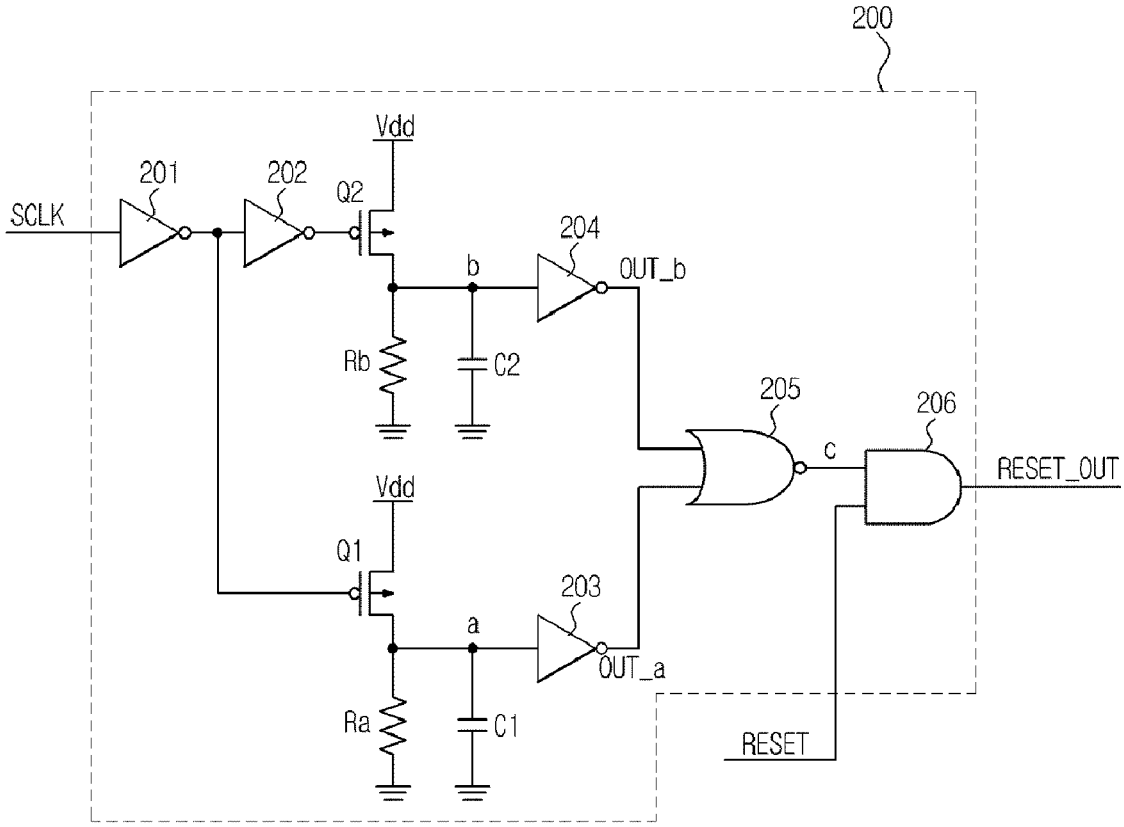
FIG. 7 is a detailed structure diagram of the reset correction unit of FIG. 5 according to an embodiment of the present general inventive concept.
Figure 8:
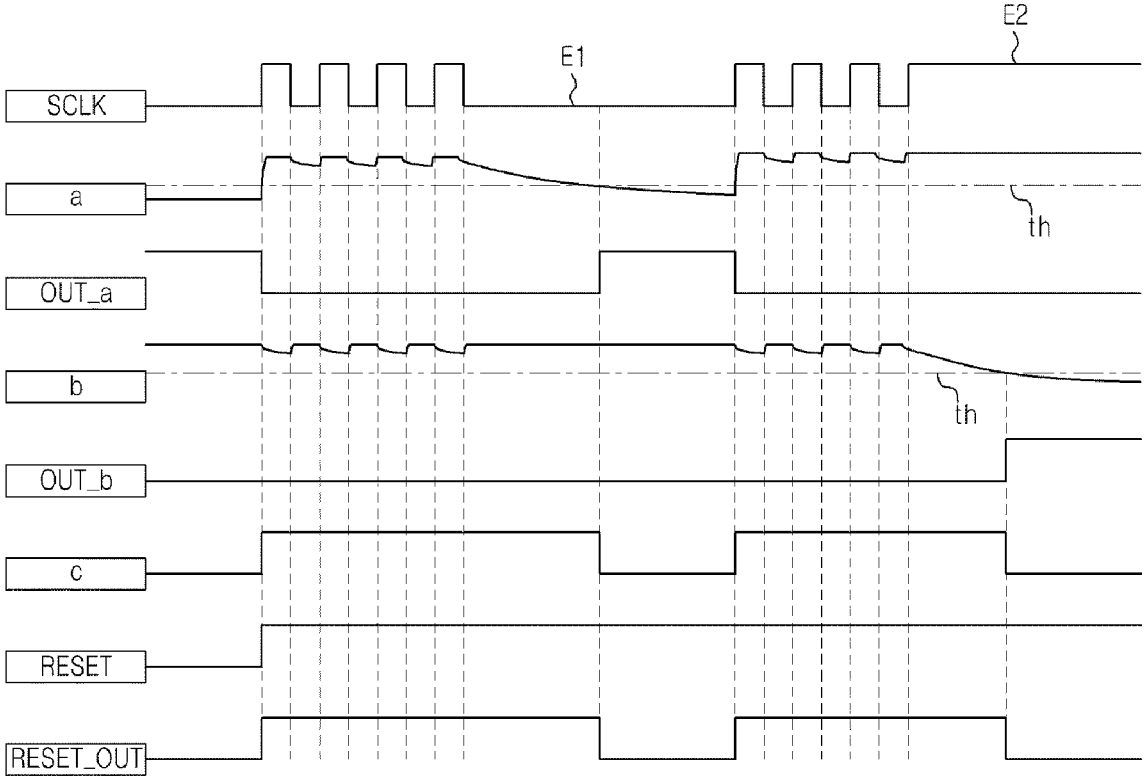
FIG. 8 is a timing chart illustrating signal timings of respective components of the reset correction unit of FIG. 7.

FIG. 7 is a detailed structure diagram of the reset correction unit according to an embodiment of the present general inventive concept, and FIG. 8 is a timing chart illustrating signal timings of respective components of the reset correction unit of FIG. 7.

As illustrated in FIG. 7, the reset correction unit 200 can receive the system clock SCLK and the reset signal RESET, and can output the corrected reset signal RESET_OUT.

In this embodiment, since the system clock SCLK is alternately switched between a high level and a low level according to a certain frequency, the error of the system clock SCLK can be divided into two cases according to a time when the error occurs, namely: a case E1 where a time period when the system clock SCLK is maintained at the low level is equal to or greater than the reference time T, and a case E2 where a time period when the system clock SCLK is maintained at the high level is equal to or greater than the reference time T. In either of the two cases E1 and E2, the reset correction unit 200 can generate the corrected reset signal RESET_OUT so as to prevent the heater from being damaged, as described in more detail below.

With reference to FIG. 7, in the case E1 where the time period when the system clock SCLK is maintained at the low level for a time period equal to or greater than the reference time T, the system clock SCLK is switched from the low level to the high level by a first inverter 201, and the system clock SCLK having the switched high level is applied to the gate of a first transistor Q1 (PMOSFET) such that the first transistor Q1 is turned off. At this time, a second transistor Q2 (PMOSFET) is turned on by the inverted low level output of the second inverter 202.

Here, if the first transistor Q1 is turned off, a first charging circuit including a first resistor Ra and a first capacitor C1 starts to be discharged. At this time, an output voltage a of the first charging circuit is decreased according to the time constant of the first charging circuit.

Thereafter, the output voltage a of the first charging circuit reaches a reference voltage th. Here, the reference voltage th is a threshold voltage of a third inverter 203, and a time when the output voltage a of the first charging circuit reaches the reference voltage th corresponds to a time when the low level of the system clock is maintained during the reference time T1. The time when the output voltage a of the first charging circuit reaches the reference voltage th can be controlled by variably setting the resistance value of the first resistor Ra and the capacitance of the first capacitor C1.

If the output voltage a of the first charging circuit reaches the reference voltage th, the output OUT_a of the third inverter 203 is switched from the low level to the high level, and the output c of a NOR gate 205 is switched from the high level to the low level.

An AND gate 206 performs an AND function of the output c of the NOR gate 205 and the original reset signal RESET (high level), and outputs the reset signal RESET_OUT having a low level state, also referred to as an initial state. In other words, the reset correction unit 200 switches the original reset signal from the enabling state (high level) to the disabling state (low level) when the system clock SCLK is maintained at the low level for a time period equal to or greater than the reference time T. Accordingly, the components 103, 104, 105 and 106 of the heater controller 100 may be initialized, and the strobe signal generator 20, which receives the disabled reset signal RESET_OUT, may disable the strobe pulse. Accordingly, the driving of the heater may be stopped.

In the case E2, where the time period when the system clock SCLK is maintained at the high level for a time period equal to or greater than the reference time T, a similar operation to that described above to correct the reset signal may be performed. In this case, if the system clock SCLK having the high level passes through the first and second inverters 201 and 202, the system clock having the high level is applied to the gate of the second transistor Q2 without change such that the second transistor Q2 is turned off. At this time, the first transistor Q1 is turned on.

If the second transistor Q2 is turned off, a second charging circuit including a second resistor Rb and a second capacitor C2 starts to be discharged. At this time, an output voltage b of the second charging circuit is decreased according to the time constant of the second charging circuit.

Thereafter, the output voltage b of the second charging circuit reaches a reference voltage th. Here, the reference voltage th is a threshold voltage of a fourth inverter 204 and a time when the output voltage b of the second charging circuit reaches the reference voltage th corresponds to a time when the high level of the system clock is maintained during the reference time T1. The time when the output voltage b of the second charging circuit reaches the reference voltage th can be controlled by variably setting the resistance value of the second resistor Rb and the capacitance of the second capacitor C2.

If the output voltage b of the second charging circuit reaches the reference voltage th, the output OUT_b of the fourth inverter 204 is switched from the low level to the high level and the output c of the NOR gate 205 is switched from the high level to the low level. The AND gate 206 then performs an AND function of the output c of the NOR gate 205 and the original reset signal RESET (high level), and outputs the reset signal RESET_OUT having a low level, or initial state. In other words, the reset correction unit 200 switches the original reset signal from the enabling state (high level) to the disabling state (low level state) when the system clock SCLK is maintained at the high level for a time period equal to or greater than the reference time T.

Accordingly, the components 103, 104, 105 and 106 of the heater controller 100 may be initialized, and the strobe signal generator 20, which receives the disabled reset signal RESET_OUT, disables the strobe pulse. Accordingly, the driving of the heater may be stopped.

Referring again to FIG. 5, the original reset signal RESET can be supplied to the reset correction unit 200 and to the AND gates of the AND gate unit 101. The reason why the reset signal is applied to the AND gates is as follows. A driving voltage may be supplied to the AND gates of the AND gate unit 101 during a time period from the generation of the original reset signal to the generation of the reset signal RESET_OUT corrected by the reset correction unit 200. In this case, when the AND gates erroneously output the heater driving signals, the heater may be unnecessarily driven. However, when the corrected reset signal is supplied to the AND gate unit 101, the AND gates are reset, and the driving of the heater may be stopped.

As described above, in a process of counting the system clock SCLK received from the printer main body, and generating the strobe pulse STRB to control the time when the current flows in the heater, if an error occurs in the system clock due to ESD, that is, if the system clock is stopped while the clock is counting, the reset correction unit can generate and supply a corrected reset signal to the components and the strobe signal generator to generate the strobe pulse such that the strobe pulse STRB is switched from the enabling state to the disabling state. Thus, the driving of the heater can be stopped. Accordingly, it is possible to prevent the heater from being damaged due to continuously driving the heater for a long period of time.

The present general inventive concept can also be embodied as computer-readable codes on a computer-readable medium. The computer-readable medium can include a computer-readable recording medium and a computer-readable transmission medium. The computer-readable recording medium is any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An ink jet image forming apparatus, comprising:

a printer main body;

a print head to communicate with the printer main body; and a reset correction unit to correct a reset signal supplied from the printer main body to the print head to an initial state when an error occurs in a system clock, and to supply the corrected reset signal to the print head to disable the print head, wherein the reset correction unit corrects the reset signal when the system clock is maintained at a certain level without change, wherein the reset correction unit comprises:

at least one charging circuit to alternately perform charging and discharging operations according to alternate states of the system clock, and a logic circuit to generate a reset signal having an initial state when a discharging voltage of the at least one charging circuit is equal to or less than a reference voltage.

2. The ink jet image forming apparatus of claim 1, wherein when the system clock is maintained in one state for a time period equal to or greater than a predetermined time period, and the logic circuit switches the reset signal from an engaged state to the initial state when the discharging voltage of the at least one charging circuit is equal to or less than the reference voltage.

3. The ink jet image forming apparatus of claim 1, wherein the at least one charging circuit includes at least one switch and at least one capacitor, both of which are operated by the system clock.

4. The ink jet image forming apparatus of claim 3, wherein when the system clock is alternately switched between a high level and a low level, the switch is turned on when the system clock has the low level such that the charging circuit is switched to a discharging mode, and is turned off when the system clock has the high level such that the charging circuit is switched to a charging mode.

5. The ink jet image forming apparatus of claim 4, further comprising at least one inverter to invert the level of the system clock, wherein the switch is connected to an output side of the inverter.

6. The ink jet image forming apparatus of claim 3, wherein the switch is a PMOSFET.

7. The ink jet image forming apparatus of claim 1, wherein if the reset correction unit includes a plurality of charging circuits, any one charging circuit generates the reset signal having the initial state when the system clock is maintained at a first level and another charging circuit generates the reset signal having the initial state when the system clock is maintained at a second level different from the first level.

8. A method of controlling an ink jet image forming apparatus in which a printer main body and a print head exchange a signal so as to perform a printing operation, the method comprising:

receiving a system clock from the printer main body and generating a reset signal;

detecting whether an error occurs in the system clock; and correcting the reset signal and generating a reset signal having an initial state when the error occurs in the system clock, wherein the detecting of the error of the system clock comprises detecting the error on the basis of a time period when the level of the system clock is constantly maintained, and wherein the detecting of the error of the system clock comprises detecting that the error occurs if a discharging voltage of at least one charging circuit reaches a reference voltage when the level of the system clock is constantly maintained and the at least one charging circuit is in a discharging mode.

9. The method of claim 8, wherein the detecting of the error of the system clock comprises detecting the error when the high level of the system clock is maintained during a predetermined time period or when the low level of the system clock is maintained during the predetermined time period.

10. An ink jet image forming apparatus, comprising:

a print head;

a printer main body to generate a reset signal and a system clock to drive the print head; and a reset correction unit to correct the reset signal and disable the print head when the system clock is maintained substantially constant beyond a predetermined time period, wherein the reset correction unit corrects the reset signal when the system clock is maintained at a certain level without change, wherein the reset correction unit comprises:

at least one charging circuit to alternately perform charging and discharging operations according to alternate states of the system clock, and a logic circuit to generate a reset signal having an initial state when a discharging voltage of the at least one charging circuit is equal to or less than a reference voltage.

11. The ink jet image forming apparatus of claim 10, wherein the system clock switches between a high level and a low level, and the reset correction unit corrects the reset signal when the system clock is maintained at the high level or the low level beyond the predetermined time period.

12. The ink jet image forming apparatus of claim 10, wherein the print head comprises:

a heater unit; and a strobe signal generator to generate a strobe pulse to drive the heater unit, wherein the corrected reset signal print is communicated to the strobe signal generator to stop the heater unit.

13. A method of controlling a print head of an ink jet image forming apparatus, the method comprising:

generating a reset signal and a system clock to drive the print head; and detecting whether an error occurs in the system clock; and correcting the reset signal to disable the print head when the system clock is maintained substantially constant beyond a predetermined time period, wherein the detecting of the error of the system clock comprises detecting the error on the basis of a time period when the level of the system clock is constantly maintained, wherein the detecting of the error of the system clock comprises detecting that the error occurs if a discharging voltage of at least one charging circuit reaches a reference voltage when the level of the system clock is constantly maintained and the at least one charging circuit is in a discharging mode.

14. The method of claim 13, wherein the system clock switches between a high level and a low level, and the reset signal is corrected when the system clock is maintained at the high level or the low level beyond the predetermined time period.

* * * * *